US006843430B2

(12) United States Patent
Boticki et al.

(10) Patent No.: US 6,843,430 B2
(45) Date of Patent: Jan. 18, 2005

(54) LOW LEAKAGE LIQUID ATOMIZATION DEVICE

(75) Inventors: John A. Boticki, Racine, WI (US); James L. Bournoville, Racine, WI (US); Paul J. Larson, Racine, WI (US); Thomas A. Helf, New Berlin, WI (US); Edward J. Martens, III, Racine, WI (US); David J. Schram, Waterford, WI (US); David A. Tomkins, Racine, WI (US); Stephen M. Doerr, Racine, WI (US); Thomas Jaworski, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 95 days.

(21) Appl. No.: 10/154,509

(22) Filed: May 24, 2002

(65) Prior Publication Data

US 2003/0218077 A1 Nov. 27, 2003

(51) Int. Cl.[7] ..... B05B 1/08
(52) U.S. Cl. ..... 239/102.1; 239/102.2
(58) Field of Search ..... 239/102.1, 102.2; 220/304, 795, 300, 301, 293, 378; 128/200.14, 200.16, 200.18, 200.22; 310/326, 327

(56) References Cited

U.S. PATENT DOCUMENTS

| | | | | |
|---|---|---|---|---|
| 4,087,495 A | | 5/1978 | Umehara | 261/81 |
| 4,119,096 A | | 10/1978 | Drews | 128/194 |
| 4,301,093 A | * | 11/1981 | Eck | 261/1 |
| 4,479,609 A | | 10/1984 | Maeda et al. | 239/102 |
| 4,877,989 A | * | 10/1989 | Drews et al. | 310/323.01 |
| 4,911,866 A | | 3/1990 | Monroe | 261/81 |
| 5,021,701 A | | 6/1991 | Takahashi et al. | 310/345 |
| 5,152,456 A | | 10/1992 | Ross et al. | 239/102 |
| 5,283,496 A | | 2/1994 | Hayashi et al. | 310/312 |
| 5,297,734 A | | 3/1994 | Toda | 239/102 |
| 5,312,281 A | * | 5/1994 | Takahashi et al. | 446/25 |
| 5,518,179 A | | 5/1996 | Humberstone et al. | 239/102 |
| 5,529,055 A | * | 6/1996 | Gueret | 128/200.16 |
| 5,657,926 A | | 8/1997 | Toda | 239/102 |
| 5,758,637 A | | 6/1998 | Irvi et al. | 128/200 |
| 5,823,428 A | | 10/1998 | Humberstone et al. | 239/4 |
| 6,014,970 A | | 1/2000 | Irvi et al. | 128/200 |
| 6,205,999 B1 | | 3/2001 | Irvi et al. | 128/200 |
| 6,296,196 B1 | | 10/2001 | Denen et al. | 239/4 |
| 6,450,419 B1 | * | 9/2002 | Martens, III et al. | 239/102.1 |

FOREIGN PATENT DOCUMENTS

EP 0897755 A2 2/1999

* cited by examiner

*Primary Examiner*—Gene Mancene
*Assistant Examiner*—Thach H. Bui

(57) ABSTRACT

A battery operated atomizer device comprising, in a housing (22), a liquid reservoir (30) from which a capillary type liquid delivery system (38) extends to contact a piezoelectric actuator an atomization plate assembly (34), the assembly (34) being supported by means of wire-like elements (36) in cantilever fashion over the liquid delivery system, the liquid delivery system comprising an outer tubular member (52) and a solid rod (56) which have facing surfaces configured to define between them, longitudinal capillary liquid passages.

55 Claims, 14 Drawing Sheets

LOW LEAKAGE LIQUID ATOMIZATION DEVICE

BACKGROUND OF THE INVENTION

1. Field of the Invention

This invention relates to piezoelectrically actuated vibratory type liquid atomization devices and more particularly it relates to novel structures for such devices which are characterized by low liquid loss and high efficiency handling of liquids being atomized.

2. Description of the Related Art

U.S. Pat. No. 5,758,637 to Ivri et al. shows a liquid dispensing apparatus in which a cantilever beam is attached to an electronic circuit and which bends and vibrates in response to actuation of a piezoelectric element attached to the beam. The vibration of the beam is transferred to a shell member to produce atomization of liquid supplied to the shell member. U.S. Pat. No. 5,297,734 also shows a bendable cantilever beam of piezoelectric material which is attached to an atomization plate.

U.S. Pat. No. 4,119,096 to Drews shows a medical inhaler in which a transducer is mounted in cantilever fashion within the inhaler. U.S. Pat. No. 5,283,496 to Hayashi et al. shows a crystal resonator which is held by supporting wires of electrically conductive material and which press on the sides of the resonator. U.S. Pat. No. 4,087,495 to Umehara show an ultrasonic air humidifying device in which an ultrasonic vibrator assembly is held in place by a pair of stays. U.S. Pat. No. 4,911,866 shows a fog producing apparatus that is suspended within a liquid bath by means of carrier members extending from a float.

U.S. Pat. No. 5,657,926 to Toda shows an ultrasonic atomizing device in which a piezoelectric vibrator and a vibrating plate are held between supporting elements and an adjacent end of a liquid keeping material which extends out of a liquid bath.

U.S. Pat. No. 5,021,701 to Takahashi et al. shows a piezoelectric vibrator mounting system for a nebulizer, wherein a piezoelectric actuator is energized via spring loaded electrodes which press on the sides of the actuator.

U.S. Pat. No. 4,301,093 to Eck and U.S. Pat. No. 5,518,179 to Humberstone et al., as well as European Patent Publication EPO 897 755 A2 to Satoshi Yamazaki et al. show wick arrangements extending from liquid reservoirs to atomization plates which are vibrated by piezoelectric actuators.

U.S. Pat. No. 5,152,456 to Ross et al., U.S. Pat. No. 5,823,428 to Humberstone et al., U.S. Pat. No. 6,014,970 to Ivri et al. and U.S. Pat. No. 6,205,999 to Ivri et al. show various means for supporting a piezoelectric actuator and an atomization plate.

U.S. Pat. No. 4,479,609 to Maeda et al. shows a felt wick core which is enclosed by and which extends out from the ends of protective plates. However, the wick is neither solid nor dimensionally stable.

None of the foregoing patents address the problem that one encounters upon atomizing liquids which are characterized by low viscosity and low surface tension which are common among fragrances, air fresheners and insecticides. These liquids tend to migrate along the structural elements of the atomizer device and cause wetting of its various surfaces. As a result it becomes difficult to handle the atomization device. Further, its performance deteriorates and valuable liquid is lost without being atomized.

Further, none of the above patents discloses any arrangement to ensure that liquid is supplied to a vibrating plate from a fixed location relative to the plate in order to provide a sufficient supply of liquid without appreciably damping the vibrations of the plate.

Finally, the prior art fails to disclose any arrangements for efficiently holding a vibrating atomization plate and actuator element in a liquid atomization device.

SUMMARY OF THE INVENTION

In one aspect this invention minimizes the migration of liquid being atomized so that the atomizing device itself remains dry and easy to handle. At the same time the performance of the device is maintained at a high level and no undesired leakage and loss of liquid is experienced.

According to this one aspect, there is provided a novel liquid atomizing device which comprises a source of liquid to be atomized and which is maintained at a fixed position by a support. The device also includes an atomization assembly comprising an atomization plate and a piezoelectric actuator connected to vibrate the plate. A mounting structure extends from the support to the atomization assembly to hold the atomization assembly at a predetermined location relative to the fixed position. The mounting structure is configured to have a small cross-section relative to its length to minimize migration of liquid between the atomization assembly and the support.

In another aspect of the invention the mechanical support and electrical supply to a piezoelectric actuator and atomization plate of a liquid atomizing device are combined to simplify construction and to minimize liquid migration. According to this other aspect, there is provided a novel liquid atomization device which comprises a housing and a liquid atomization plate. The atomization plate is secured to a piezoelectric actuating element to be vibrated thereby in response to alternating voltages applied to the actuating element whereby vibration of the plate causes atomization of liquid supplied to it. An electrical circuit is mounted in the housing to supply alternating electrical voltages. A pair of electrically conductive wire-like cantilever elements are connected to receive alternating voltages from the electrical circuit. The wire-like elements extend from a fixed support in the housing and are arranged to be in electrical contact with opposite sides of the actuating element to apply the alternating voltages from the electrical circuit across the actuating element. The wire-like elements also support the actuating element and the liquid atomization plate in cantilever fashion in the housing. A liquid delivery system is arranged to deliver a liquid to be atomized to the atomization plate while it is being vibrated.

In a further aspect of the invention a piezoelectric actuator and an atomization plate are held in an arrangement which directs the flow of atomized liquid particles from an atomization device and prevents non-atomized liquid from spreading to other parts of the atomizing device. According to this further aspect, a piezoelectric actuator and an atomization plate which is coupled to the actuator to be vibrated thereby are provided with a novel support. The novel support comprises a housing having an internal cavity. A piezoelectric actuator and an atomization plate which is coupled to be vibrated by the actuator, are located in the cavity. A resilient element is arranged in the cavity to press against the actuator and to hold the actuator in the housing. The housing has openings from the cavity which are in alignment with the atomization plate to allow passage of liquid from an external supply to the atomization plate and to permit passage of liquid droplets from the plate to the atmosphere.

According to a further aspect of the invention there is provided a novel liquid delivery system for transferring liquid from a reservoir to a vibratory atomization plate. This novel liquid delivery system comprises a first capillary element in liquid contact with liquid contained in a reservoir and a second capillary element in capillary communication with a vibratory atomization plate. The first capillary element has an outer end extending out from an upper end of the reservoir and it also has a first surface which is moveable in a vertical direction relative to a corresponding second surface on the second capillary element. The first and second capillary surfaces are in capillary communication with each other. Thus, variations on the vertical dimensioning of the first element will not have any effect on the vibrational movements of the atomization plate.

According to another aspect of the invention there is provided a novel liquid reservoir This novel reservoir comprises a liquid container which is removably attachable to an atomization device for delivery of a liquid to a vibrating plate in the atomization device and an elongated member having capillary passages extending from one end thereof to an opposite end. A lower region of the elongated member is solid and dimensionally stable and extends from within the liquid container out through an opening in a upper region of the container. The elongated member has a compressible upper region which is fixed to the upper end of the lower region and which is located outside the container. Because the lower region of the elongated member is solid, it may be solidly secured to the container opening with a minimum of leakage. At the same time, because the upper region of the elongated member is compressible, it will not interfere with vibrations of the vibrating plate irrespective of variations in the vertical dimensioning of the elongated member.

According to a still further aspect of the invention, there is provided a novel liquid delivery system for transferring liquid from a reservoir to a vibrating atomization plate. This novel liquid delivery system comprises a solid tubular member having a longitudinal passage extending therethrough and a solid rod which extends through the longitudinal passage. The solid tubular member and the solid rod have mutually facing surfaces which are configured to form capillary passages extending from one end of the solid rod to its other end. This novel liquid delivery system is dimensionally stable and maintains the point at which liquid is delivered to a vibratory atomization plate at a precise location so as not to interfere with the vibration of the plate.

According to a still further aspect of the invention, there is provided a novel piezoelectric atomization device which comprises a structural support, a liquid reservoir and an atomizer assembly. The liquid reservoir comprises a liquid container and a liquid delivery system extending from within the liquid container to a location above the container. The liquid delivery system is of a solid material and is dimensionally stable. The atomizer assembly comprises a piezoelectric actuator and an orifice plate coupled to the actuator to be vibrated thereby upon energization of the actuator to atomize liquid supplied to an under surface of the orifice plate. The liquid reservoir is replaceably mounted on the structural support. The atomizer assembly is also mounted on the structural support in a manner such that said under surface of the orifice plate is located above and in alignment with an upper surface of the liquid delivery system. At least one of the liquid reservoir and the atomizer assembly is resiliently mounted on the structural support for up and down movement against a resilient bias, whereby the upper surface of the liquid delivery system engages the under surface of the orifice plate irrespective of the vertical position of the upper surface of the liquid delivery system when the liquid reservoir is mounted on the structural support.

According to a still further aspect of the invention, there is provided a novel piezoelectric atomizing device which comprises a fixed support, a piezoelectric actuator and an atomization plate to be vibrated by the actuator. The support comprises a pair of elongated resilient members which extend from the fixed support. The elongated resilient members have outer end elements which press against opposite sides, respectively, of the piezoelectric actuator to hold the actuator and the atomization plate in cantilever fashion in a predetermined position.

DETAILED DESCRIPTION OF THE PREFERRED EMBODIMENTS

Figure 1:
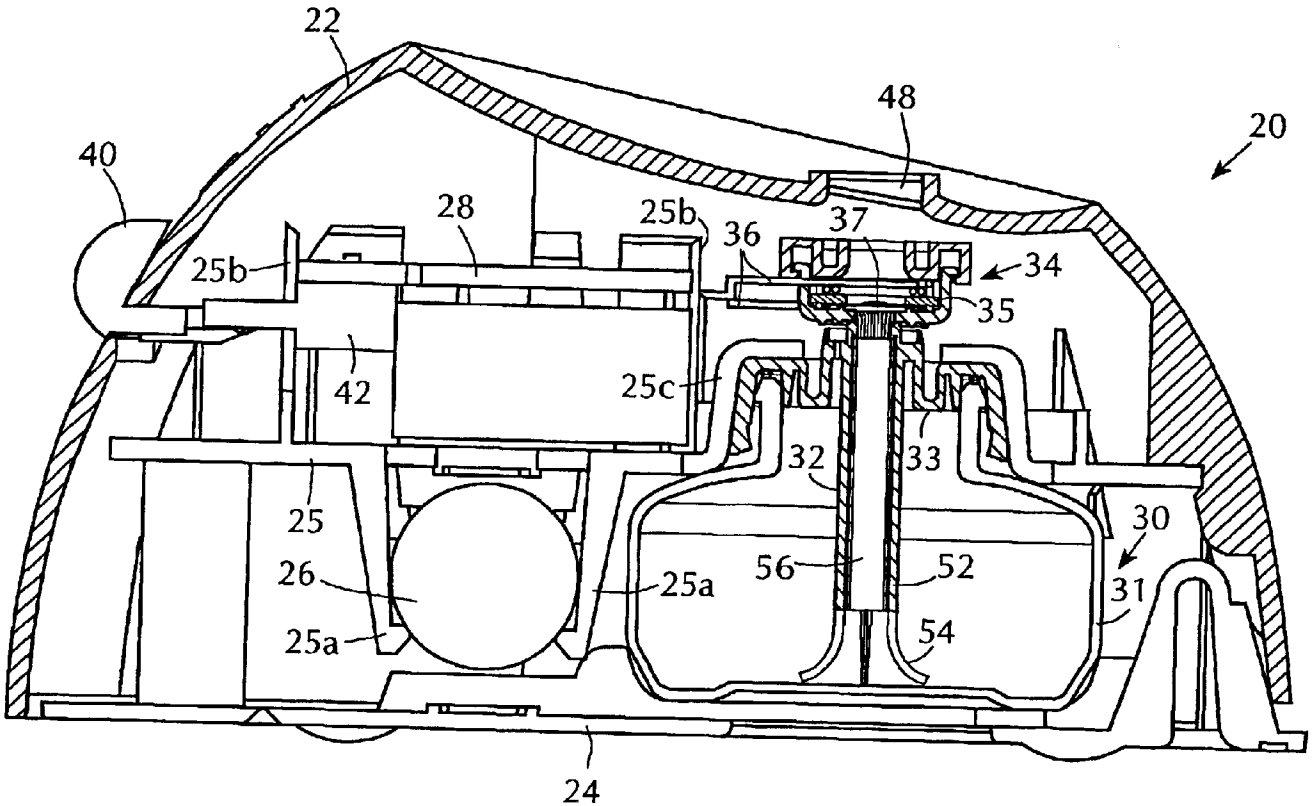
FIG. 1. is an elevational section view of a piezoelectrically actuated atomization device which forms one embodiment of the invention.

As shown in FIG. 1, a piezoelectrically actuated atomization device 20 according to the present invention comprises a housing 22 formed as a hollow plastic shell and closed by a flat bottom wall 24. A horizontal platform 25 extends across the interior of the housing 22. A battery 26 is supported by means of support prongs 25*a* which extend down from the underside of the platform 25 inside the housing 22. In addition, a printed circuit board 28 is supported on support elements 25*b* which extend upwardly from the platform 25. A liquid reservoir 30 assembly is replaceably mounted to the underside of a dome-like formation on the platform 25.

The liquid reservoir assembly 30 comprises a liquid container 31, a cap or plug 33 which closes the top of the container and a liquid delivery system 32 which extends from within the liquid container and through the cap or plug 33, to a location above the liquid container. The liquid container 31, the liquid delivery system 32 and the cap or plug 33 are formed as a unitary liquid reservoir assembly 30 which may be replaced in the atomizer devices as a unit. The liquid container 31 holds a liquid to be atomized. The cap or plug 33 is constructed to be removably mounted on the underside of the dome-like formation 25*c* on the platform 25. Preferably the plug 33 and the platform are formed with a bayonet attachment (not shown) for this purpose. When the replaceable liquid reservoir assembly 30 is mounted on the platform 25, the liquid delivery system 32 extends up through a center opening in the dome-like formation 25*c*. The liquid delivery system 32, which is described in greater detail hereinafter, operates by capillary action to deliver liquid from within the liquid container 31 to a location just above the dome-like formation 25*c* on the platform 25.

An atomizer assembly 34 is supported on the platform 25 in cantilever fashion by means of resilient elongated wire-like supports 36 at a location just over the center opening of the dome-like formation 25*c* on the platform 25. As will be described more fully hereinafter, in this embodiment the supports 36 resiliently press on upper and lower surfaces of the atomizer assembly 34 to hold it in place but in a manner which allows it to move up and down against the resilient bias of the wire-like supports. The wire-like supports 36 extend as cantilever elements from the printed circuit board 28, which in turn is securely mounted on the platform 25 by the support elements 25*b*. The atomizer assembly 34 comprises an annularly shaped piezoelectric actuator element 35 and a circular orifice plate 37 which extends across and is soldered or otherwise affixed to the actuator element 35. This construction of a vibrator type atomizer assembly is per se well known and is described for example in U.S. Pat. No. 6,296,196. Accordingly, the atomizer assembly 34 will not be described herein in detail except to say that when alternating voltages are applied to the opposite upper and lower sides of the actuator element 35 these voltages produce electrical fields across the actuator element and cause it to expand an contract in radial directions. This expansion and contraction is communicated to the orifice plate 37 causing it to flex so that a center region thereof vibrates up and down. The center region of the orifice plate 37 is domed slightly upward to provide stiffness and to enhance atomization. The center region is also formed with a plurality of small orifices which extend from the lower or under surface of the orifice plate to its upper surface.

When the atomizer assembly 34 is supported in cantilever fashion by the support members 36, the center region of the orifice plate 37 is positioned in contact with the upper end of the liquid delivery system 32 of the liquid reservoir 30. In the present embodiment the wire-like support members 36 are electrically conductive and are connected to electrical circuits on the circuit board 28. Thus alternating voltages produced by these circuits are communicated to the opposite sides of the actuator element 35 and cause it to expand and contract so as to vibrate the center region of the orifice plate 37 up and down. The atomizer assembly 34 is thereby supported above the liquid reservoir assembly 30 such that the upper end of its liquid delivery system 32 touches the underside of the orifice plate 37. Thus the liquid delivery system delivers liquid from within the liquid container 31 by capillary action to the underside of the orifice plate 37, which upon vibration, causes the liquid to pass through its orifices and be ejected in the form of very small droplets from its upper surface.

It will be appreciated from the foregoing that the horizontal platform 25 serves as a common structural support for both the liquid reservoir assembly 30 and the atomizer assembly 34. Thus the horizontal platform maintains the liquid reservoir assembly, and particularly the upper end of its liquid delivery system 32, in alignment with the orifice plate 37 of the atomizer assembly 34. Moreover, because at least one of the atomizer assembly 34 and the liquid reservoir assembly 30 (in this case the atomizer assembly), is resiliently mounted, the upper end of the liquid delivery system 32 will always press against the under surface of the orifice plate 37 and piezoelectric actuator 35 irrespective of dimensional variations which occur when one liquid reservoir is replaced by another. This is because if the upper end of the liquid delivery system of the replacement reservoir is higher or lower than the upper end of the liquid delivery system of the original liquid reservoir, the action of the wire-like supports 36 will allow the atomizer assembly to move up and down according to the location of the upper end of the replacement liquid delivery system, so that the upper end will always press against the underside of the orifice plate and actuator element. It will be appreciated that the liquid delivery system must be of a solid, dimensionally stable, material so that it will not become deformed when pressed against the underside of the resiliently supported orifice plate. Examples of such solid, dimensionally stable, liquid delivery systems are described hereinafter.

In operation, the battery 26 supplies electrical power to circuits on the printed circuit board 28 and these circuits convert this power to high frequency alternating voltages. A suitable circuit for producing these voltages is shown and described in U.S. patent application Ser. No. 09/519,560, filed on Mar. 6, 2000, and the disclosure of that application is hereby incorporated by reference. As described in the aforesaid application, the device may be operated during successive on and off times. The relative durations of these on and off times can be adjusted by an external switch actuator 40 on the outside of the housing 22 and coupled to a switch element 42 on the printed circuit board 28.

The present invention permits the atomization of liquids which have very low viscosity and low surface tension while minimizing migration of unatomized liquid throughout the atomizer device. This is achieved in the present invention by means of mounting members, such as the wire-like mounting members 36, which have very small cross-sectional surface areas relative to their length. As a result of these small surface areas, the migration of liquid back to the printed circuit board is minimized so that the components of the atomizer 20 remain dry and free of the liquid being atomized. Preferably, the cross-sectional configuration of the wire-like mounting members 36 is circular because this minimizes their outer surface areas and restricts migration of liquids along those surfaces. In addition, liquid migration along the members 36 can be further reduced by making these members of a material, or coated with a material that is not easily wettable. In addition, by making the mounting members 36 of an electrically conductive material, they serve the dual function of supporting the actuator and atomizer assembly 34 and of supplying energizing voltages to the piezoelectric actuator element 35. This reduces the amount of interconnection between the atomizer and actuator unit 34 and the other elements of the atomizer device 20. As a result, liquid migration back to these other elements is further reduced. It should be understood that any resilient material capable of supporting the piezoelectric actuator 35 and the orifice plate 37 may be used for the mounting members 36. Examples of suitable materials are high carbon spring steel wire, alloy steel wire, stainless steel wire, non-ferrous alloy wire, cold rolled carbon steel strip, stainless steel strip, non-ferrous alloy strip, etc. Plastic materials which are not easily wettable, and which have sufficient strength to support the atomizer assembly, could also be used.

Figure 2:
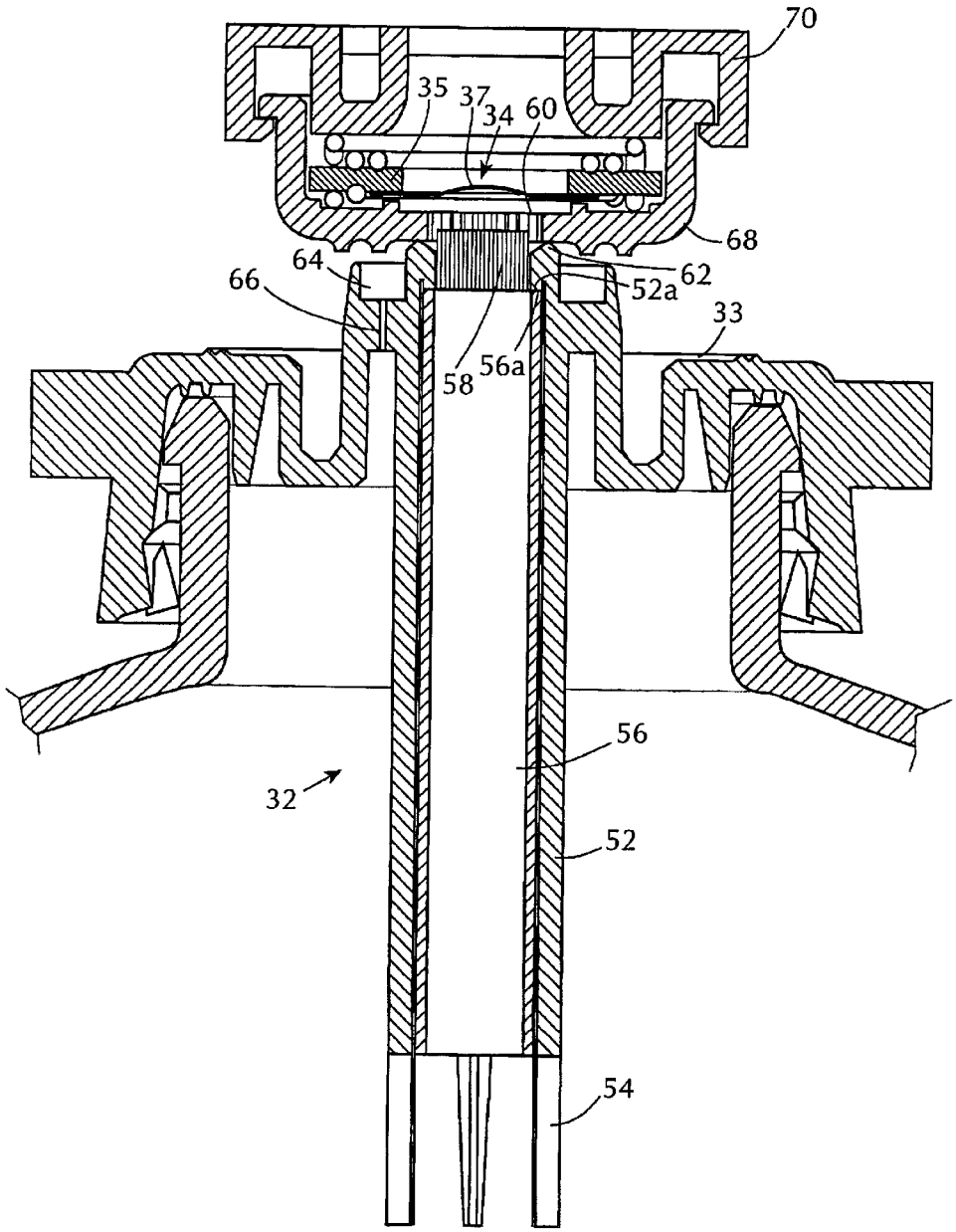
FIG. 2 is an enlarged elevational section view of a liquid feed system and a piezoelectrically actuated atomizer assembly used in the atomization device of FIG. 1.

As can be seen in FIG. 1, the liquid delivery system 32 extends from inside the liquid container 31 up through the plug 33 in the top of the container. The construction of the liquid delivery system 32 employed in this embodiment is best shown in FIG. 2. The liquid delivery system includes an outer tubular member 52 which is integral with and extends down from the plug formation to the bottom of the container. The lower end of the tubular member 52 is split around its periphery so that it can bend to flare outwardly at the bottom of the container 31 as shown at 54 in FIG. 1. A rod 56 extends up through the outer tubular member 52 from near the bottom thereof to a location just above its upper end. The rod 56 is formed in an upper region thereof with longitudinally extending serrations 58. The rod 56 is formed near its upper end with an upwardly facing shoulder 56*a* which abuts a downwardly facing shoulder 52*a* within the tubular member 52. The abutment of these shoulders precisely positions the upper end of the rod 56. The mutually facing surfaces of the tubular member 52 and the rod 56 are configured to form longitudinally extending capillary passages which draw liquid up from within the container 31 to the upper end of the rod 56.

The upper end of the rod 56 is formed with longitudinally extending serrations 58 which draw the liquid up beyond the upper end of the plug 33. As can be seen in FIG. 2, the upper end of the rod 56 enters into an opening 60 in the bottom of the atomizer assembly 34 to supply liquid to a location just below the orifice plate 37.

The upper end of the plug 33 is shaped with a peripheral abutment 62 which rests against the bottom of the atomizer assembly 34. Because the liquid supply system 31 is comprised of solid materials, its upper end is thereby positioned at a precise location with respect to the vibrating orifice plate 37. This ensures that sufficient liquid will be delivered to the orifice plate while avoiding any interference with the vibratory movement of the plate. The plug 33, the outer tubular member 52 and the rod 56 are formed of solid material, preferably plastic, such as, for example, polypropylene. Thus, the liquid delivery system is dimensionally stable and delivers liquid to a fixed location, unlike a compliant wick whose upper end can be moved by even insignificant forces.

It should be noted that while the liquid delivery system shown in FIG. 2 is particularly advantageous in certain applications, other liquid delivery systems can be used in connection with various other aspects of the invention. For example, where a solid, dimensionally stable liquid delivery system is used, it may comprise a solid porous plastic material such as Porex® sold by the Porex Corporation of Fairburn, Ga. For other aspects of the invention, wherein the liquid delivery system does not have to be dimensionally stable, compliant wicks, such as wicks made of fabric, yarn, etc., may be used.

The plug 33 is also formed with an annular reservoir 64 around the abutment 62 to recover any excess liquid that does not become atomized by the vibrating orifice plate 37. In addition, a vent opening 66 extends down from a lower surface of the reservoir 64 to allow for pressure equalization inside the container 31.

Preferably, the mounting members 36 (FIG. 1) are made of resilient material so that the abutment 62 will always be held against the lower surface of the atomizer assembly 34 irrespective of any variations in the longitudinal dimensions of the liquid delivery system 32. This permits precise positioning of the liquid supply relative to the vibrating orifice plate 37 while accommodating dimensional differences between different liquid reservoirs which may be used in the atomizer device 20.

Figure 3:
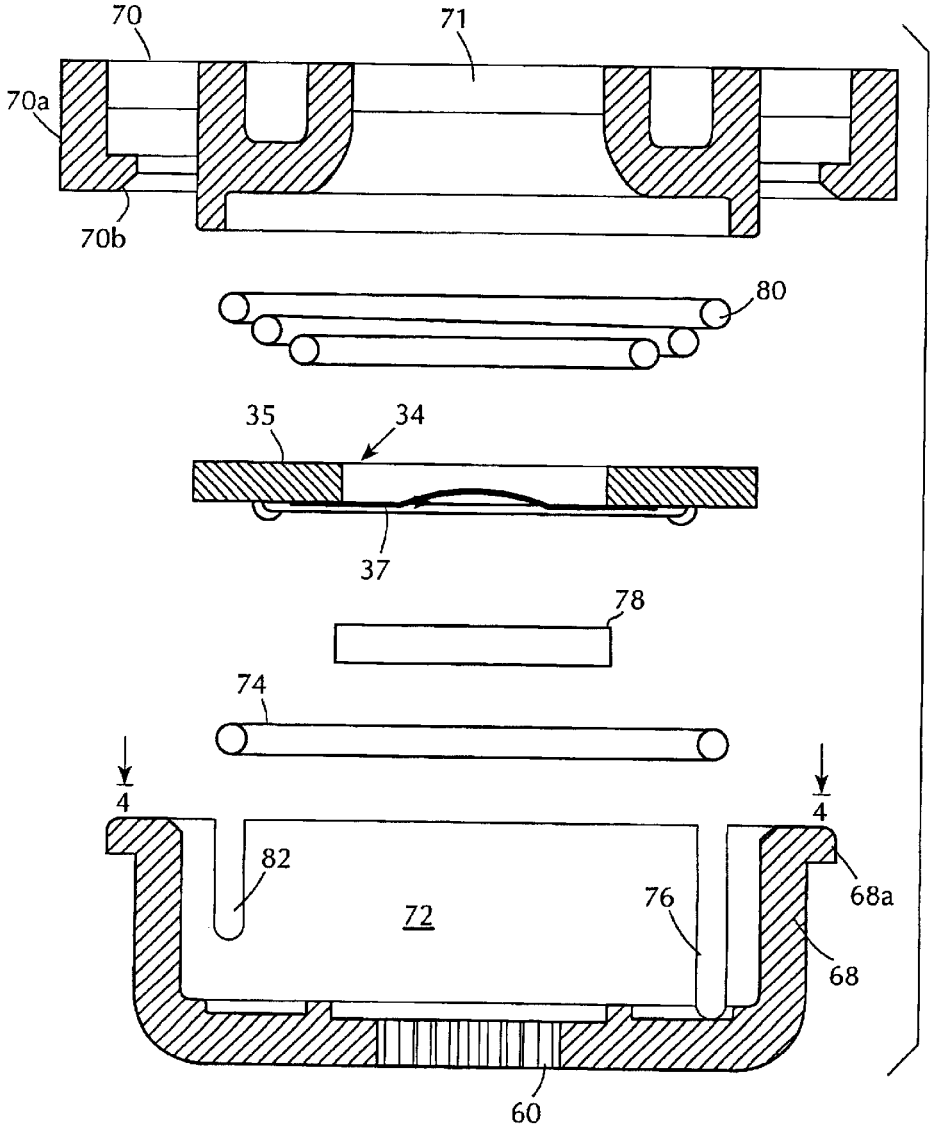
FIG. 3 is an exploded section view of the atomizer assembly of FIG. 2.
Figure 4:
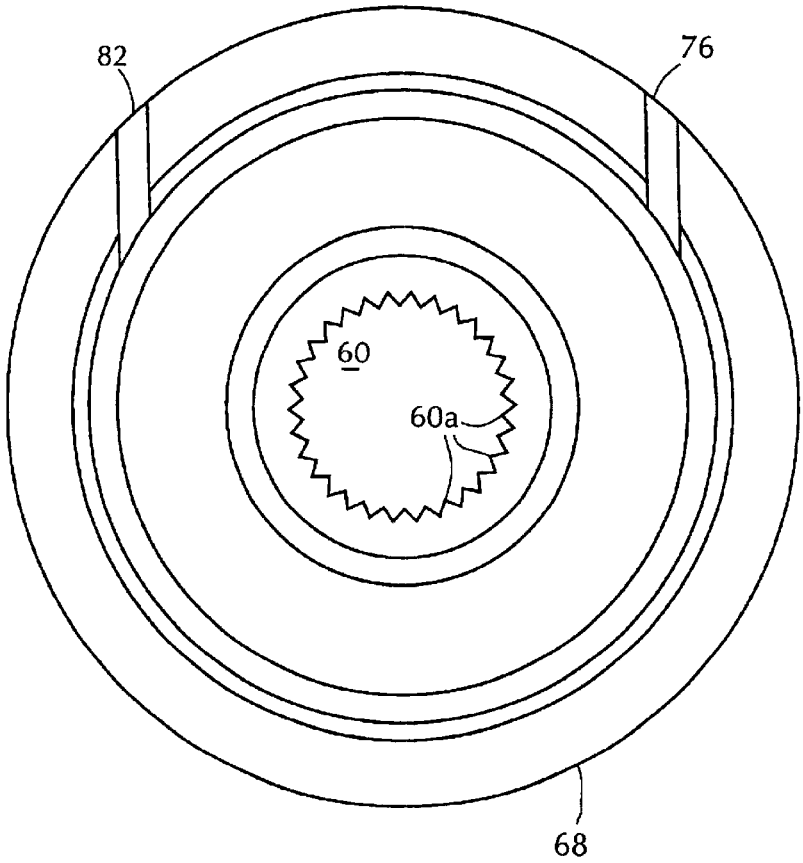
FIG. 4 is view taken along line 4—4 of FIG. 3.
Figure 5:
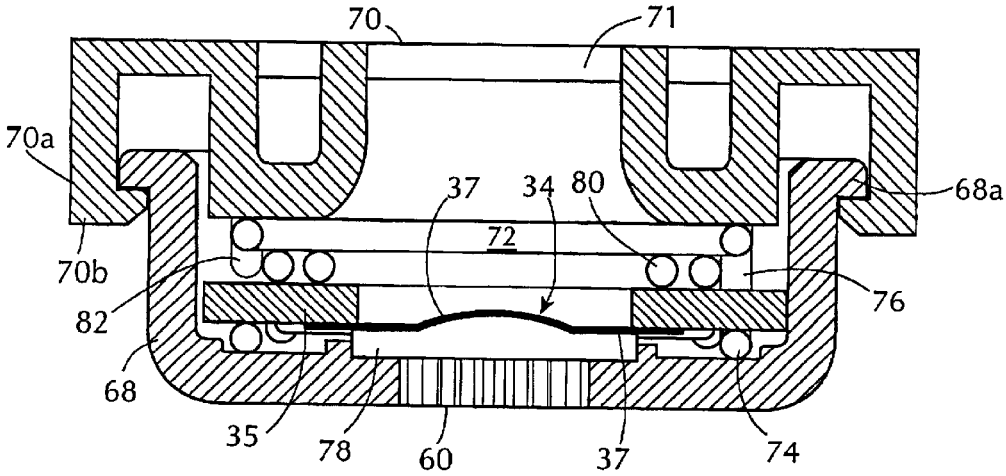
FIG. 5 is an enlarged section view of the atomizer assembly of FIG. 2.

The construction of an atomizer assembly which may be used in the present invention is best shown in the exploded view of FIG. 3, the housing member top view of FIG. 4 and the assembly view of FIG. 5. As can be seen in FIG. 3, there is provided a cup-shaped lower housing body 68 and a housing cover 70. The housing body 68 contains a cavity 72 which opens out to its upper side. The housing cover 70 extends over the cavity 72 and snaps onto the housing body. For this purpose, the housing body 68 is formed with an outwardly extending peripheral lip 68*a* around its upper edge, while the housing cover 70 is formed with a peripheral downwardly extending skirt 70*a* and an inwardly extending flange 70*b* which snaps under the lip 68*a* of the housing body 68. The housing body and the housing cover are preferably made of a suitable plastic material such as polypropylene. The top of the housing cover 70 is formed with an opening 71 through which liquid droplets produced by the vibrating orifice plate 37 are ejected. The openings 60 and 71 in the bottom and the top of the housing 68, 70 are aligned with the orifice plate 37 to allow the flow of liquid up to the lower surface of the plate and to allow the ejection of droplets from the upper surface of the plate. It will be appreciated that the housing 68, 70 serves to control the flow of liquid so as to avoid undesired side splattering of liquid droplets. The opening 71 is also shaped to provide a nozzle effect which directs the flow of the atomized liquid up and out of the atomizer in the form of a cloud.

As can be seen in FIG. 4, the opening 60 in the bottom of the housing body 68 is formed with longitudinally extending serrations 60*a* around its periphery. These serrations cooperate with the longitudinal serrations 58 along the upper portion of the rod 56 to induce the movement of liquid by capillary action up into the cavity 72 in the housing body.

An electrically conductive wire ring 74 is provided to fit inside the cavity 72 and rest against its lower surface. The wire that forms the ring 74 extends from the ring and exits out from the housing body 68 through a slot 76 in the side of the body. The wire ring 74 is integral with, and comprises an extension of, the support wires 36 shown in FIG. 1.

A disc shaped back pressure member 78, which is large enough to cover the opening 60 in the bottom of the housing body 68, is also positioned against the lower surface of the cavity 72 and abuts the underside of the orifice plate 37. The back pressure member 78 assists the pumping action of the vibrating orifice plate by ensuring that the liquid is continuously supplied to the entire domed region of the underside of the orifice plate 37 thereby avoiding the accumulation of bubbles under the plate. The back pressure member 78 should have capillary characteristics so as draw liquid up from the liquid delivery system to the underside of the orifice plate 37. The back pressure member 78 may be porous and it may comprise woven or non-woven fibrous materials. The back pressure member 78 may also comprise an open cell foam, for example Porex®, a fine mesh screen, etc. In addition, a non-porous material can be used provided it has surface capillary characteristics.

The annularly shaped actuator element 35 is arranged to fit into the cavity 74 and to rest on top of the wire ring 74. The actuator element 35 may have an electrically conductive coating along its lower surface to ensure that a uniform electrical field will be generated across the entire actuator element. During operation of the device, the wire ring 74 transfers voltages from the printed circuit board 28 to the lower surface of the actuator element 35 to energize the element.

The orifice plate 37 extends across the annularly shaped actuator element 35 and is soldered or otherwise fastened to the lower surface of the actuator element. This allows the radial expansion and contraction of the actuator element to impose radially directed forces on the plate 37 so that its center region moves up and down accordingly. It should be understood that the orifice plate 37 could also be fixed to the upper surface of the actuator element 35. The center region of the orifice plate 37 is domed upwardly slightly to provide stiffness in this region and to limit bending of the plate to a region near the actuator element 35. The domed center region of the orifice plate 37 is formed with a plurality of minute orifices through which liquid may pass and which cause the liquid to become formed into tiny droplets or mist as the plate vibrates up and down in response to the radial movements of the actuator element 35.

A helically shaped, resilient and electrically conductive wire coil 80 is located above the actuator element 35 and presses down on the element in assembly. The material of the coil 80 may be the same as that of the ring 74, e.g. spring steel. The wire that forms the coil 80 may be the same as that which forms the ring 74. This wire extends from the coil and exits out from the housing body 68 through a slot 82 in the side of the housing body 68. The wire coil 80 is integral with and outside the body 68, also becomes one of the support wires 36 shown in FIG. 1.

Turning now to FIG. 5, the atomizing assembly is shown in cross-section as assembled. As can be seen, the cover 70, when snapped onto the housing body 68, forces the helical coil 80 down against the upper side of the piezoelectric actuator 35 which in turn is forced down against the wire ring 74. In this manner direct electrical contact is maintained between the upper and lower sides of the actuator element 35 and the helical coil 80 and the wire ring 74 respectively. As mentioned previously, the coil 80 and ring 74 are electrically connected via the wire-like support member 36 to the printed circuit board 28 (FIG. 1) and thereby supply alternating electrical fields across the actuator to cause it to expand and contract radially.

It will also be seen in FIG. 5 that the diameter of the wire ring 74 is dimensioned such that the upper side of the back pressure member just touches the lower surface of the orifice plate 37. This provides precise control so that adequate liquid will be supplied to the orifice plate without appreciably damping the up and down vibration of the plate. Thus the device may be operated with maximum efficiency.

Figure 6:
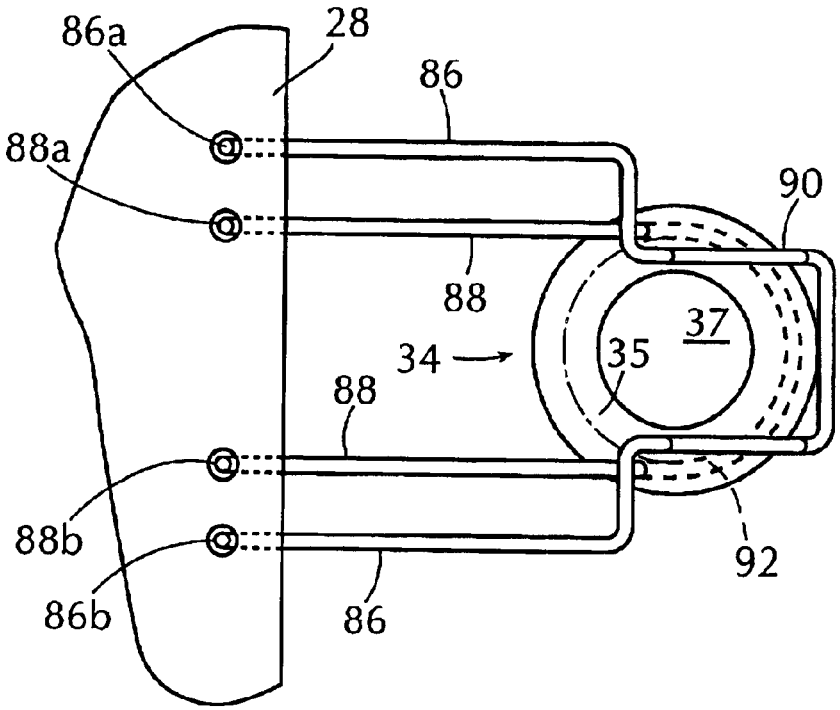
FIG. 6 is a top view of a first alternate atomizer support which may be used in the atomization device of FIG. 1.
Figure 7:
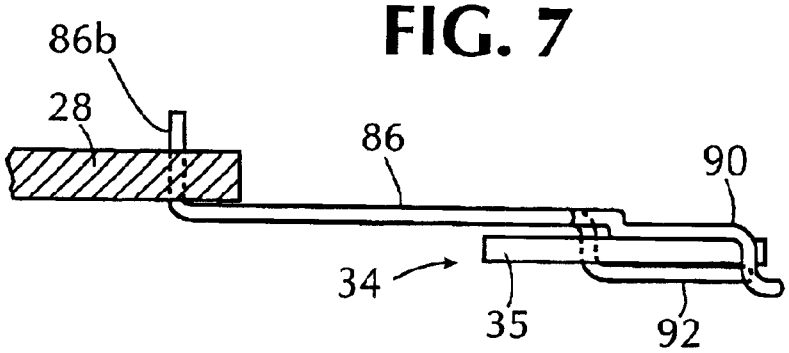
FIG. 7 is a side view of the atomizer support of FIG. 6.

An alternate support arrangement for supporting the piezoelectric actuator 35 and the orifice plate 37 is shown in FIGS. 6 and 7. As there shown, wire-like support members 86 and 88 are affixed to and extend out from the printed circuit board 28. The support members 86 and 88 may be of the same material as the support members 36 shown in FIG. 1. That is, they should be resilient and bendable and they should be electrically conductive. As can be seen in FIGS. 6 and 7, each of the support members 86 and 88 is fixed at both ends, 86*a* and 86*b* and 88*a* and 88*b*, to the printed circuit board 28 and extends outwardly therefrom in the form of upper and lower loops 90 and 92. The upper loop 90 extends over and presses down on the upper surface of the piezoelectric actuator 35 while the lower loop 92 extends under and presses upwardly against the lower surface of the piezoelectric actuator. In this manner the actuator is squeezed between and held by the upper and lower loops 90 and 92. The support members 86 and 88 are also preferably resilient so that the piezoelectric actuator 35 and the orifice plate 37 can move up and down to press against the liquid delivery system 32 (FIG. 1). As explained above, this permits the orifice plate 37 to be positioned accurately with respect to the liquid delivery system irrespective of dimensional variations that may occur when the liquid container 31 is replaced. It is also preferred that the support members 86 and 88 be electrically conductive so that they can transfer alternating electrical voltages from the printed circuit board 28 to the opposite sides of the piezoelectric actuator 35.

Figure 8:
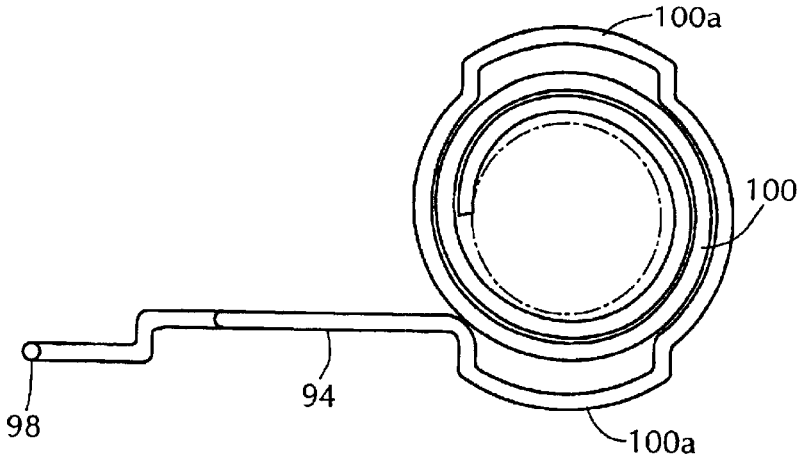
FIG. 8 is a top view of one portion of a second atomizer support which may be used in the atomization device of FIG. 1.
Figure 9:
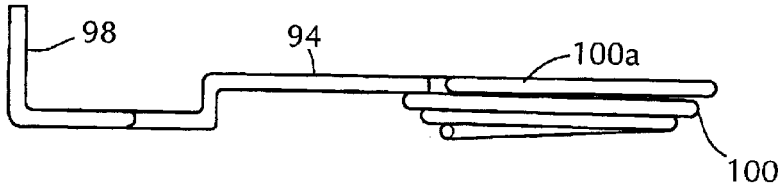
FIG. 9 is a side view of the atomizer support portion shown in FIG. 8.
Figure 10:
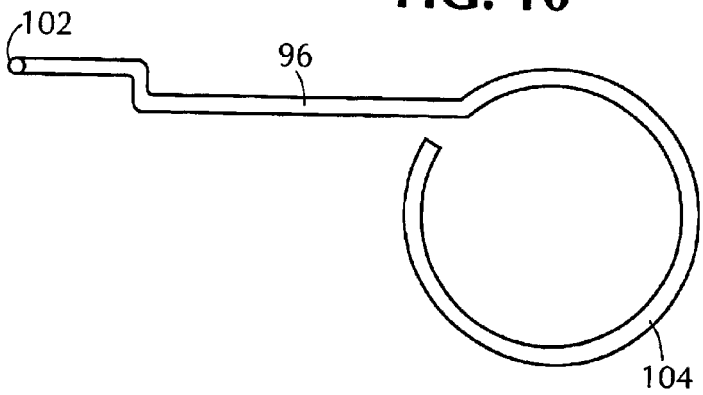
FIG. 10 is a top view of another portion of the second atomizer support which may be used in the atomization device of FIG. 1.
Figure 11:
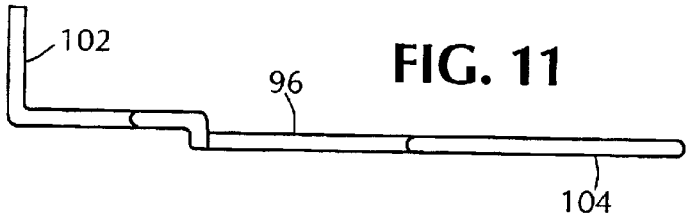
FIG. 11 is a side view of the atomizer support portion shown in FIG. 10.

A second alternate support arrangement for the piezoelectric actuator 35 and the orifice plate 37 is shown in FIGS. 8–12 This second alternate support arrangement is also formed of an upper wire-like support element 94 (FIGS. 8 and 9) and a lower wire-like support element 96 (FIGS. 10 and 11). These support elements are preferably made of the same material as the support elements 36, 86 and 88 described above.

As seen in FIGS. 8 and 9, the upper support element 94 is fixable at one end 98 to the printed circuit board 28 (FIG. 1) and extends outwardly therefrom in cantilever fashion. The other end of the upper support element 94 is bent to form a helical coil 100 which can press down against the upper surface of the piezoelectric actuator 35. The coil 100 is formed, along its uppermost turn, with ears 100*a* which protrude outwardly from the coil at diametrically opposed locations thereon. Further, as seen in FIGS. 10 and 11, the lower support element 96 is also fixable at one end 102 to the printed circuit board 28 to extend therefrom in cantilever fashion. The other end of the lower support element 96 is bent to form a ring 104 which can abut the lower surface of the piezoelectric actuator 35. Because the upper and lower support elements are resilient they can squeeze the piezoelectric actuator 35 between them, thereby simultaneously to support and to supply alternating electrical voltages from the printed circuit board 28 to the opposite sides of the actuator. The supports 94 and 96 and their respective coils 100 and 104 besides being resilient are electrically conductive; and their ends 98 and 102 are connected to a source of alternating electrical voltages, for example the output terminals on the printed circuit board 28.

Figure 12:
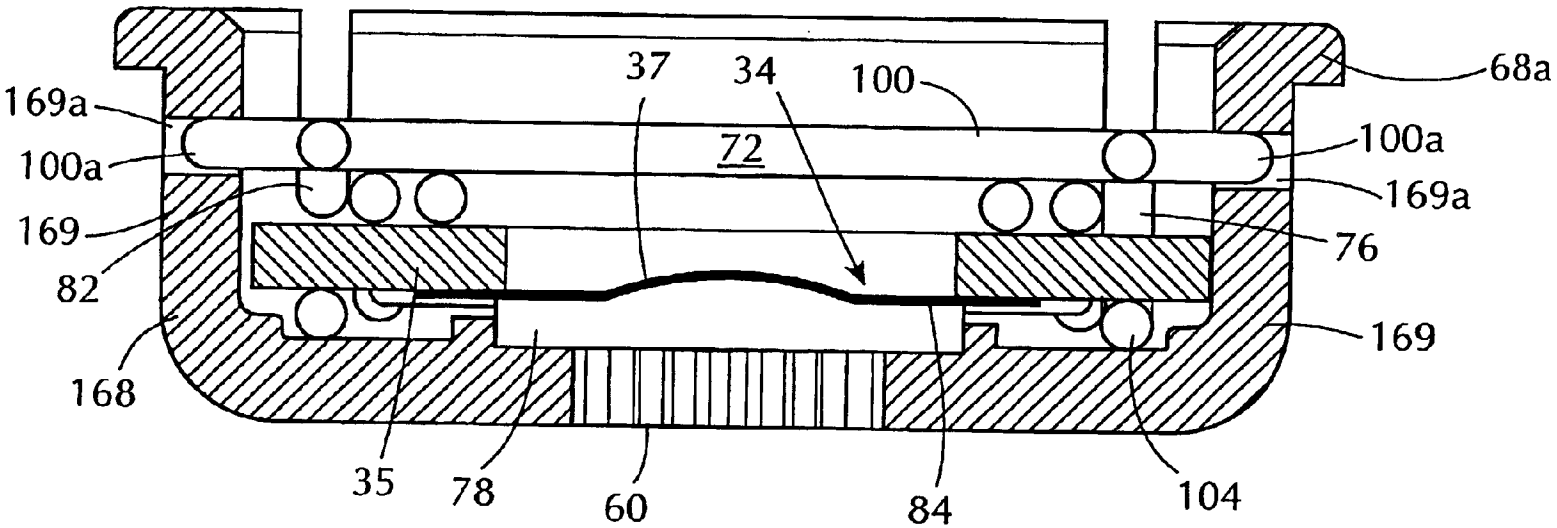
FIG. 12 is a view similar to FIG. 5 but showing an alternate atomization device which incorporates a one piece housing.

Turning now to FIG. 12, there is shown a one piece housing 168 which is of the same basic configuration as the housing body 68 shown in FIG. 5. The housing 168 in the embodiment of FIG. 12, however, has no cover. Instead, side walls 169 of the housing 168 are formed with diametrically opposed slots or recesses 169*a* which open into the cavity 72 and which accommodate the ears 100*a* of the coil 100. As can be seen in FIG. 12, the ears 100*a* are held in the housing by the slots or recesses 169*a*, This in turn causes the coil 100 to press down on the piezoelectric actuator 35 and orifice plate 37 and squeeze these elements between the coil 100 and the coil 104. Thus the housing 168, the actuator 35 and the orifice plate 37 are supported by the upper and lower support elements 94 and 96. Also, because the supports 94 and 96 and their respective coils 100 and 104 are electrically conductive, they transmit the alternating voltages generated by the circuits on the printed circuit board 28 to the opposite sides of the piezoelectric actuator 35, thereby causing it to expand and contract accordingly.

Figure 13:
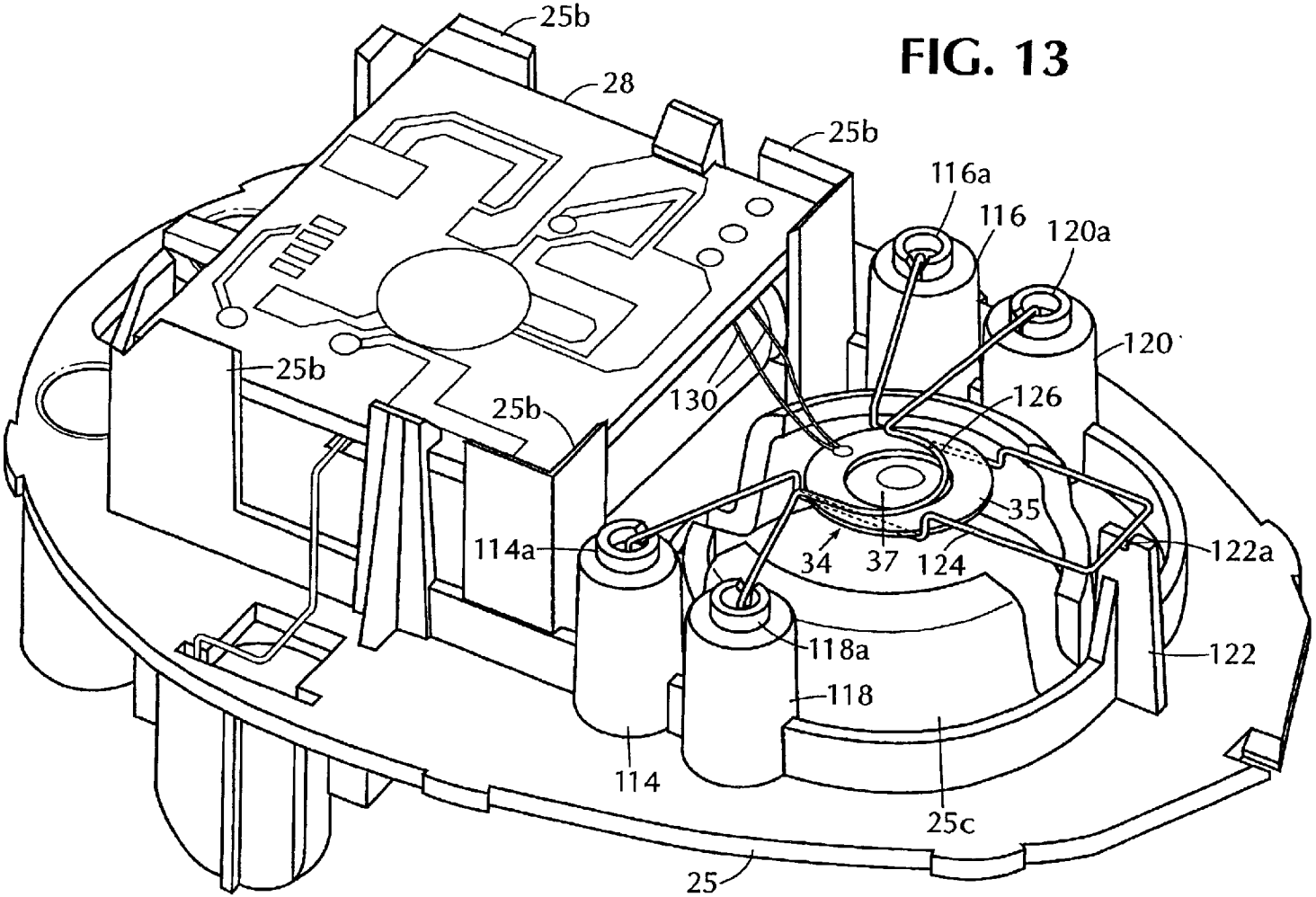
FIG. 13 is a perspective view of the interior of an alternate embodiment of the present invention.
Figure 14:
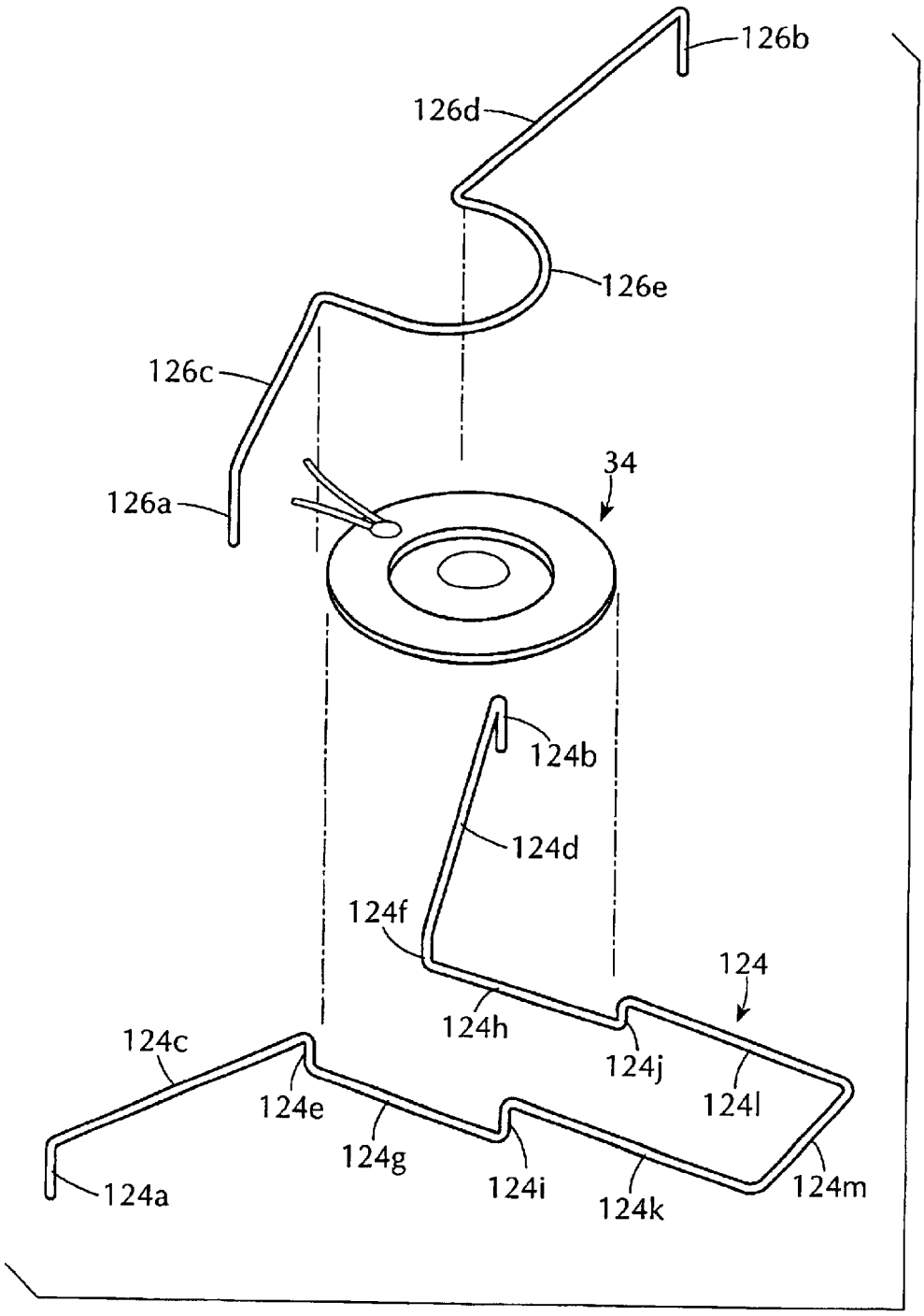
FIG. 14 is an exploded view showing actuator support elements used in the embodiment of FIG. 13.

FIGS. 13 and 14 illustrate another embodiment of the invention which is advantageous in that it physically separates the printed circuit board 28 from the atomizer assembly 34 and ensures precise positioning of the actuator assembly 34 (i.e. the piezoelectric actuator 35 and the orifice plate 37) relative to the platform 25 and the upper end or the liquid delivery system 32 shown in FIG. 1.

As shown in FIG. 13, the printed circuit board 28 is mounted on supports 25*b* which are integral with and extend up from the horizontal platform 25. In this embodiment however, the atomizer assembly 34 (i.e. the piezoelectric actuator 35 and the orifice plate 37) is not supported from the printed circuit board 28. Instead, in this embodiment, four support posts 114, 116, 118 and 120 are provided which extend up from the platform 25 on opposite sides of the dome-like formation 25*c*. These support posts are solidly affixed to and may be may be integral with the platform 25. Two of the support posts 114 and 116 are located closer to the printed circuit supports 25*b* on opposite sides of the atomizer assembly 34. The other two support posts 118 and 120 are located farther from the printed circuit supports 25*b*, also on opposite sides of the atomizer assembly 34. Another support element 122 extends up from the horizontal platform in front of the atomizer assembly 34. Hollow cylindrically shaped anchor elements 114*a*, 116*a*, 118*a* and 120*a* are formed at the tops of the support posts 114, 116, 118 and 120, respectively.

One end of a lower wire-like actuator support 124 is anchored in the anchor element 114*a* and extends from the support post to the actuator element 35. The actuator support 124 then bends down and extends forwardly across a secant of the actuator element 35. From there, the actuator support 124 then extends out to and passes through a slot 122*a* in the upper end of the support element 122 and back to and across another secant of the actuator element 35. Finally the support 124 extends to the support post 116 where its opposite end is secured to the anchor element 116*a*. Also, one end of an upper wire-like actuator support 126 is anchored to the anchor element 118*a* in the support post 118. The upper actuator support 126 extends from the support post 118 to the actuator element 35 and then extends partially around the upper surface of the actuator. From there the second actuator 126 support extends to the support post 120 where its opposite end is secured to the anchor element 120*a*. The ends of the wire-like actuator supports 124 and 126 are secured to the respective anchor elements 114*a*, 116*a*, 118*a* and 120*a* by means of a snap fit into these elements. Alternatively the ends of the supports may be heat staked into the anchor elements.

The lower and upper wire-like actuator supports 124 ands 126 are resilient and they press, respectively, against the underside and the upper side of the actuator 35 to hold it in place The lower actuator support 124 also maintains the actuator 35 against horizontal movement by virtue of bends in the first actuator support 124 at each end of the actuator secant crossed by the support 124. The resiliency of the wire-like supports 124 and 126 permit the actuator element 35 to move up and down by a certain amount so as to accommodate variations in the height of replacement liquid containers which use solid or dimensionally stable capillary type liquid delivery systems. Thus when a replacement liquid container is inserted into the atomizer, the upper end of its liquid delivery system will contact the atomizer assembly 34 irrespective of whether its upper end is higher or lower than the height of the upper end of the liquid delivery system which it replaces. The resilient support provided by the lower and upper wire-like supports 124 and 126 permits the atomizer assembly 34 (comprising the actuator 35 and the orifice plate 37) to remain precisely positioned relative to the liquid delivery system 32 while accommodating these different heights. Because of this, the atomizer assembly 34 remains in contact with the upper end of the liquid delivery system 32 of the replacement reservoir.

It will be appreciated from the foregoing that, as in the embodiment of FIG. 1, the actuator element 35 in the embodiment of FIG. 13 is supported by means of the supports 124 and 126 at a particular position relative to the dome like formation 25*c* whereby it is maintained at a predetermined height above the liquid delivery system of a reservoir mounted to the underside of the dome-like formation 25*c*. Also, as is the case in the embodiment of FIG. 1, the actuator element 35 is resiliently supported by the wire-like supports 124 and 126 so that it can move up and down to accommodate different liquid reservoirs having liquid delivery systems of different heights.

Unlike the embodiment of FIG. 1, the embodiment of FIG. 13 does not supply alternating electrical fields to the actuator element 35 via the support wires 124 and 126. Instead, in the embodiment of FIG. 13, electrical power is supplied from the printed circuit board 28 via flexible wires 130 which extend from the printed circuit board 28 to the opposite sides of the actuator element 35.

Turning now to the exploded view of FIG. 14, it can be seen that the under side support member 124 is bent into a configuration which includes downwardly directed ends 124*a* and 124*b*. These downwardly directed ends extend down into the anchor elements 114*a* and 116*a* at the upper ends of the support posts 114 and 16 in FIG. 12 where they are fixed. The support member 124 has first cantilever portions 124*c* and 124*d* which extend respectively from the ends 124*a* and 124*b* to locations at the periphery of the actuator element 35. At this point, the support element includes bent down regions 124*e* and 124*f* which form abutments to prevent backwardly directed horizontal movement of the actuator element 35. The support element then includes forwardly directed under supports 124*g* and 124*h* which extend along secants on the underside of the actuator element 35. From there the support element 124 is bent upwardly to form abutment regions 124*i* and 124*j* which prevent forwardly directed horizontal movements of the actuator 44. The support element 124 the includes forwardly extending portions 124*k* and 124*l* which are connected to each other by a front portion 124*m*. This front portion is supported in the slot 122*a* in the further support 122.

The upper side support element 126 is also formed at its ends with downwardly directed elements 126*a* and 126*b* which are fixed in anchor elements 118*a* and 120*a* at the tops of the support posts 118 and 120 (FIG. 13). Cantilever portions 126*c* and 126*d* extend from the downwardly directed elements 126*a* and 126*b* to a semi-circular shaped upper support region 126*e* which extends partially around the upper surface of the actuator element 35.

As in the case of the wire-like supports 36 in FIG. 1, the support elements 124 and 126 in the embodiment of FIGS. 13 and 14 are resilient so as to permit up and down movement of the actuator element 35.

Figure 15:
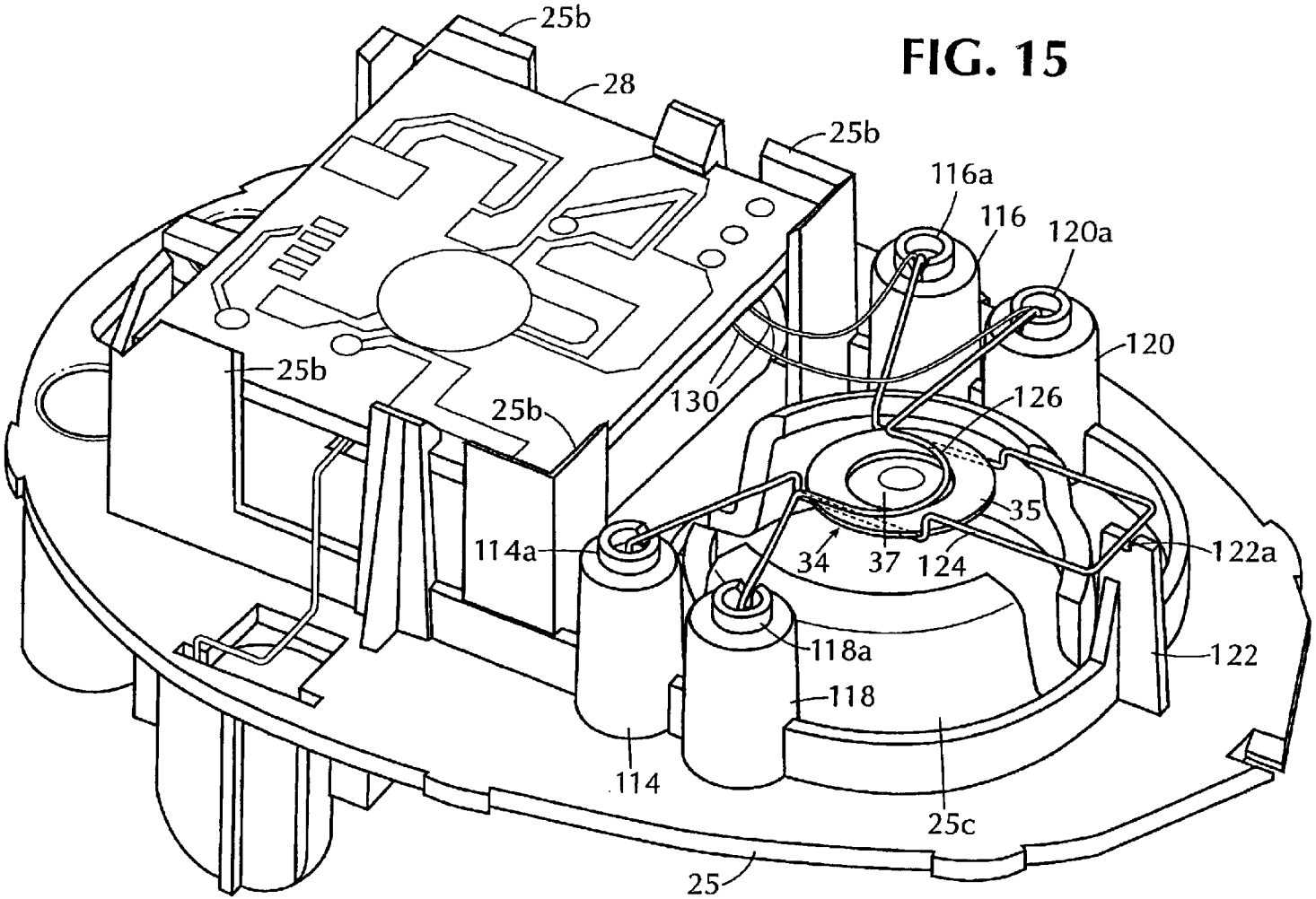
FIG. 15 is a view similar to FIG. 13 but showing a different arrangement to supply alternating electrical voltages to the actuator.

The embodiment of FIG. 15 is the same as that of FIGS. 13 and 14 except that the wires 130 which supply alternating electrical fields to the opposite sides of the actuator element 35 do not extend directly to the actuator from the printed circuit board 28. Instead, the wires 130 in the modification of FIG. 15 extend from the printed circuit board 28 to the anchor formations 116*a* and 120*a* of the support posts 116 and 120 where they are fixed and are electrically connected to the downwardly extending portions 124*b* and 126*b* of the wire-like supports 124 and 126. In this embodiment the supports 124 and 126 are electrically conductive. This allows alternating voltages from the printed circuit board 28 to be communicated through the wire-like supports 124 and 126 to the opposite sides of the actuator element 35.

Figure 16:
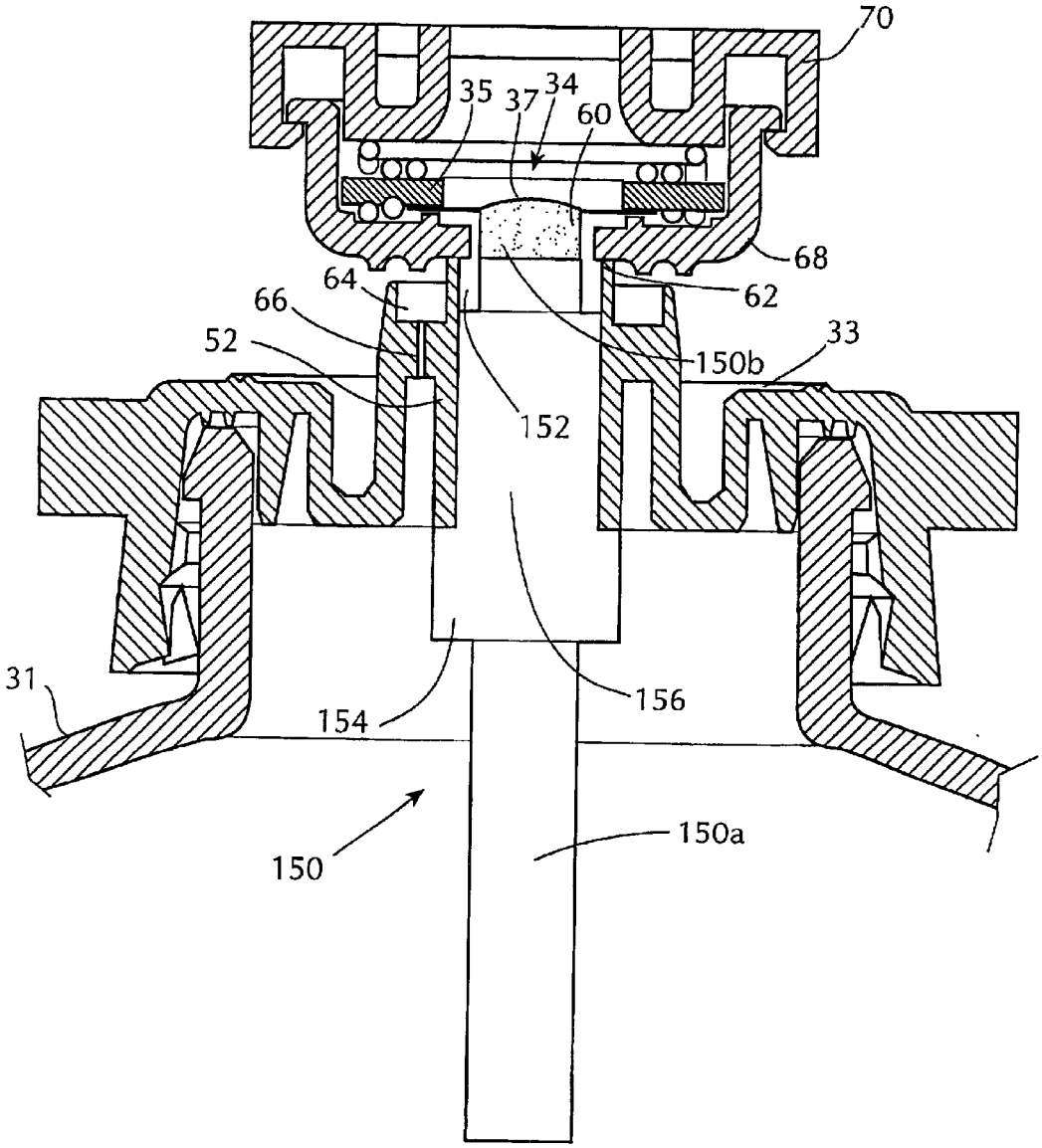
FIG. 16 is a view similar to FIG. 2 but showing a first alternate form of a liquid delivery system.

FIG. 16 is similar to FIG. 2 but shows an alternate form of liquid delivery system. As can be seen in FIG. 16 there is provided in place of the tubular member 52 and the rod 56 of FIG. 2, an elongated member 150 having a lower region 150*a* which extends from within the liquid container 31 out through an opening 152 in the upper region of the container, and an upper region 150*b* which is fixed to the upper end of the lower region. The elongated member 150 is formed with capillary passages which extend from one end of the member to its opposite end. The lower region 150*a* of the elongated member 150, which extends from within the container 31 out through the opening 152, is solid and dimensionally stable; and the upper region 150*b* of the elongated member 150, which is entirely outside the container 31, is compressible. Because the lower region of the elongated member 150 is solid, it may be solidly secured to the container opening 152 with a minimum of leakage. At the same time, because the upper region 150*b* of the elongated member is compressible, it will not interfere with vibrations of the vibrating plate irrespective of variations in the vertical dimensioning of the elongated member 150 or variations in its vertical height when the reservoir 31 is attached to the atomization device.

The solid lower region 150*a* of the elongated member 150 may be made of any moldable or machinable solid which is formed with capillary passages extending from one end to the other end. The lower region may comprise, for example, porous plastic formed by the sintering discrete particles of a thermoplastic polymer. An example of a suitable solid porous plastic material is sold under the trademark POREX® by Porex Technologies Corp. of Fairburn, Ga. In the embodiment shown in FIG. 16, the tubular member 52 has been shortened to terminate inside the plug 33. The lower region 150*a* of the elongated member 150 is formed with a collar 154 which abuts against the lower end of the tubular member 52. Also, the lower region 150*a* is formed with an enlarged diameter 156 which fits closely withing the tubular member 52. In this way the elongated member 150 is securely held to the container 31 in a precise location in a manner is which leakage is minimized.

The compressible upper region 150*b* of the elongated member 150 may be made of any resiliently compressible material which will maintain its porosity and capillary characteristics when compressed. Expanded plastic foam material is suitable for this purpose. The upper region must be fixed to the lower region so that it can be integrated with the liquid delivery system. This avoids the necessity of messy reassembly when the liquid reservoir is replaced in the atomization device. Preferably, the upper end of the lower region 150*a* is heated to a point that allows the upper region 150*b* to become adhered to the lower region. In any event, the fixing together of the upper and lower regions should be such that the capillary characteristics of the elongated member are not compromised. Other means of attachment which do not significantly affect the overall capillary characteristics of the elongated member 150 may also be used.

Figure 17:
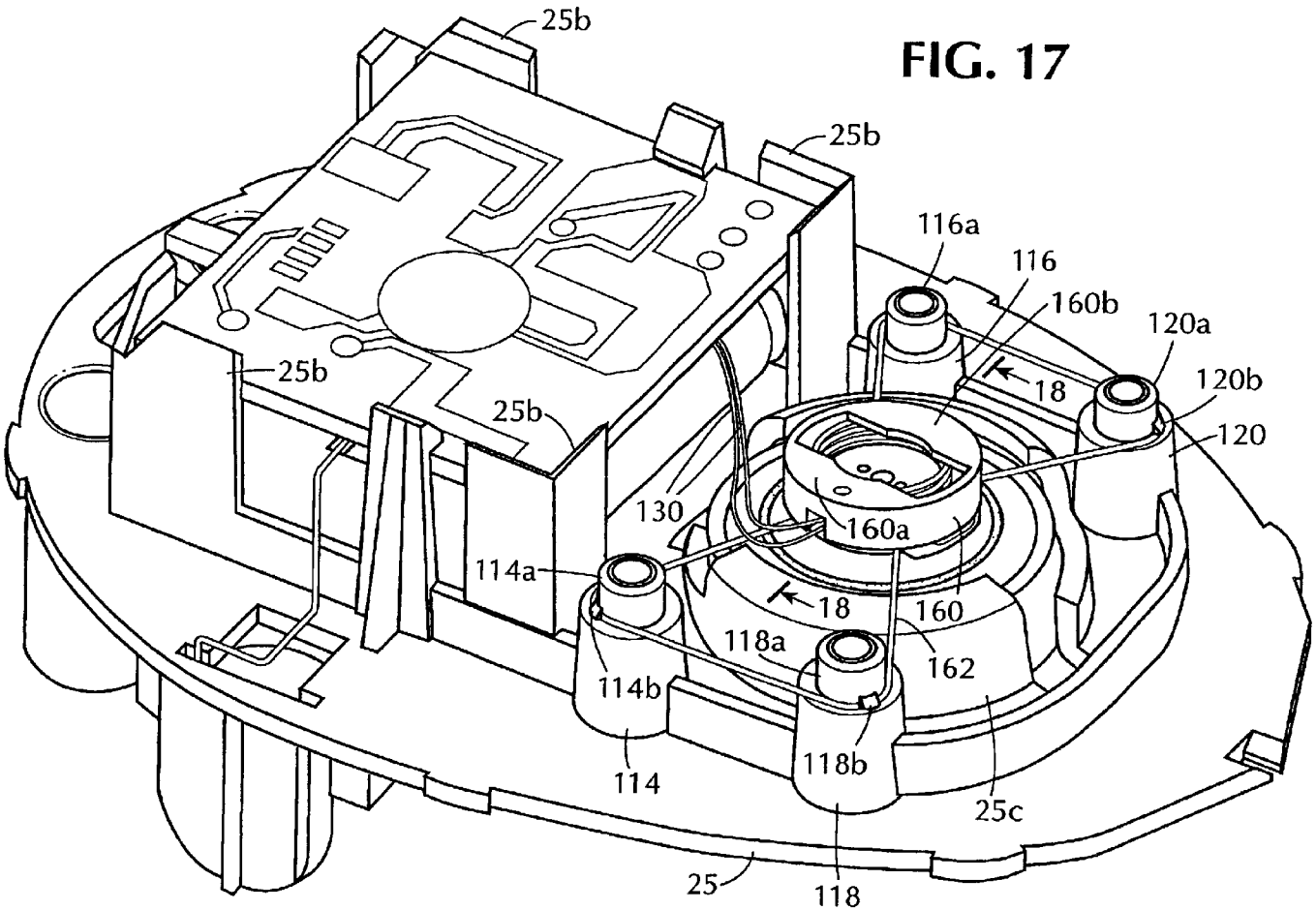
FIG. 17 is a view similar to FIG. 13 and showing another alternate embodiment of the present invention.
Figure 18:
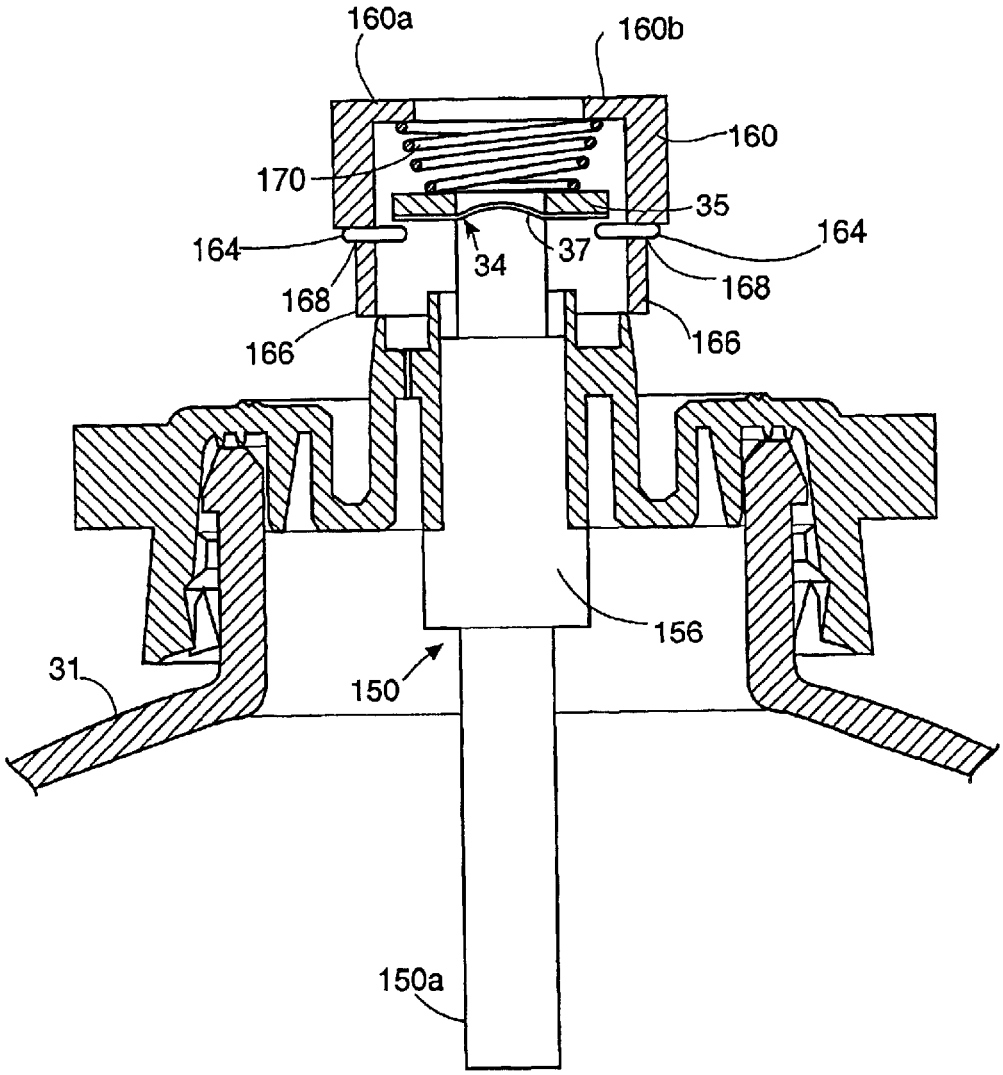
FIG. 18 is an enlarged fragmentary section view taken along line 18—18 of FIG. 17.
Figure 19:
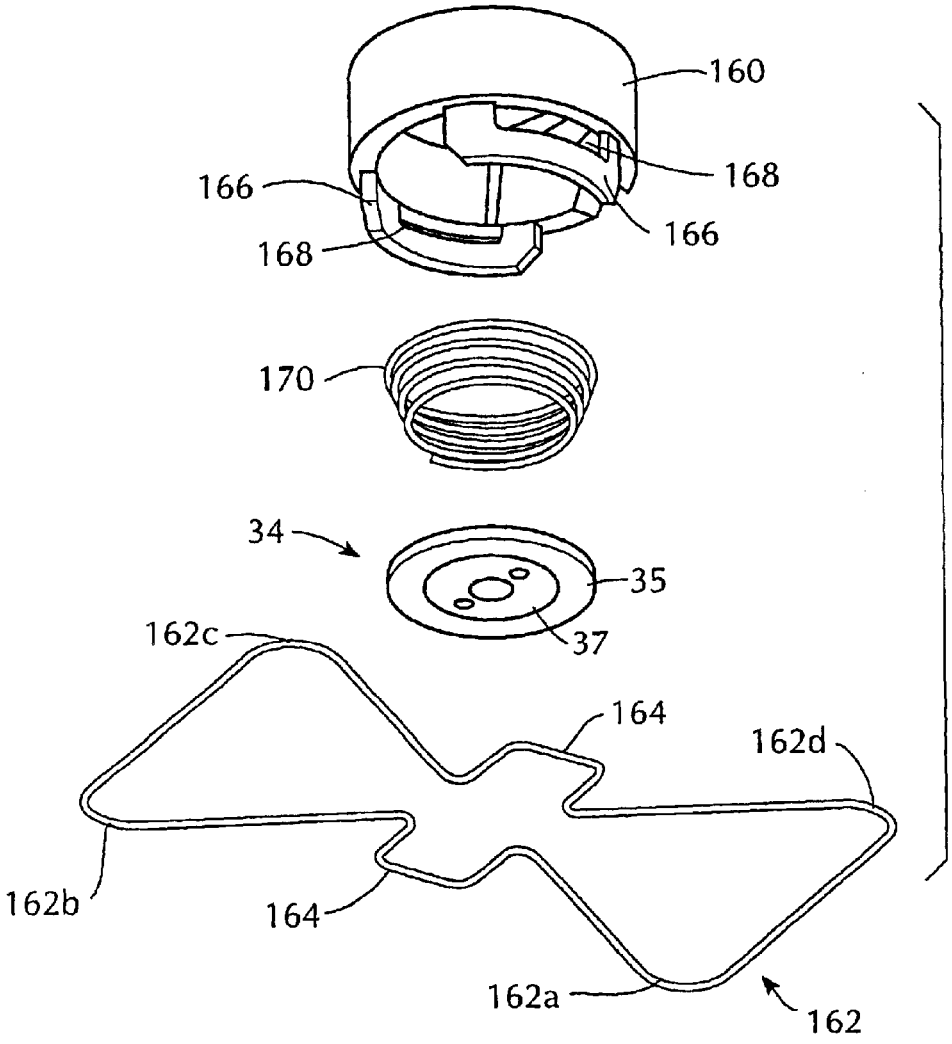
FIG. 19 is an exploded perspective view of an atomizer assembly support used in the embodiment of FIGS. 17 and 18.

In the further alternate embodiment of FIGS. 17, 18 and 19, the atomizer assembly 34 is supported in a polypropylene retainer 160 which in turn is supported by means of a bow tie shaped wire retainer 162 which is looped around the post extensions 114*a*, 116*a*, 118*a* and 120*a*. The wire retainer 162 is snapped over retaining formations 114*b*, 116*b* (not shown), 118*b* and 120*b* on the post extensions and is thereby held to the posts.

The wire retainer 162 is preferably spring steel wire, shaped as shown in FIG. 19 and welded or otherwise joined, e.g. by twisting, to form a continuous loop. As seen in FIG. 19 the loop has four outside corners 162*a*, 162*b*, 162*c* and 162*d* which fit over the post extensions 114*a*, 116*a*, 118*a* and 120*a*. The retainer tapers inwardly from the corners and is bent outwardly in a center region to form two tab shaped insert portions 164.

The retainer 160, as shown in FIGS. 18 and 19, is in the form of a hollow cylinder with to opposed downwardly extending skirt portions 166. Slots 168 are formed in the skirt portion 166 where the meet the body of the retainer 160. These slots are open to the inside of the skirt portions but it is not necessary that they open to the outside of the skirt portions. These slots accommodate the tab shaped insert portions 164 of the wire retainer 162 as shown in FIG. 18.

As shown in FIGS. 17 and 18, the upper end of the retainer 160 is formed with inwardly extending retainer ledges 160*a* and 160*b*. However, the upper end of the retainer 160 is mostly open. A tapered coil spring 170 is fitted into the retainer 160 so that its upper end is pressed against the underside of the ledges 160*a* and 160*b*. As shown, the atomizer assembly 34 is pressed up against the spring 170 so that the atomizer assembly fits inside the retainer 160. In the course of assembly the atomizer assembly 34 is forced against the spring 170 until it moves past the slots 168. The tab shaped insert portions 164 of the wire retainer 162 are pressed in toward each other and aligned with the slots 168. The insert portions are then allowed to spring into the slots so that inner corners 162*e* of the wire retainer locate under the atomizer assembly to hold it in place with the coil spring 170 partially compressed. After the coil spring 170, the atomizer assembly 34 and the retainer insert portions 164 are assembled to the retainer 160 as above described this subassembly is attached to the atomizer chassis by fitting the corners of the retainer over the support post extensions until they snap into place over the snap formations on the post extensions.

As can be seen in FIG. 18, the atomizer assembly 34 is thus held within the retainer 160 in a manner which allow it to be moved up and down under the bias of the coil spring 170. This accommodates variations in the positions of the upper end of the wicking member 150 of a replacement reservoir and thereby reduces the need for dimensional precision in the design of the reservoir and its wicking member. The spring 170 preferably has a very small spring coefficient so that variations in the vertical location of the upper end of the wicking member do not significantly affect the amount of pressure it exerts on the atomizer assembly 34. This assures that the atomizing performance is maintained irrespective of variations in the vertical location of the upper end of the wicking member. It will be appreciated that other resilient elements may be used in place of the spring 170 to allow for variation in the vertical location of the upper end of the wicking member, so long as such other resilient elements do not significantly affect the amount of pressure the wicking member exerts on the atomizer assembly.

INDUSTRIAL APPLICABILITY

The embodiments described herein provide high efficiency operation of a piezoelectrically actuated atomizer with minimum liquid leakage. Further, the atomizer of this invention can be manufactured to precision tolerances and at low cost.

What is claimed is:

1. A device for atomizing liquids, said device comprising:

a support;

a source of liquid to be atomized, said source being maintained at a fixed position by said support;

an atomization assembly which includes an atomization plate and a piezoelectric actuator connected to said atomization plate to cause said plate to vibrate in response to the application of alternating voltages across said actuator; and a wire-like mounting structure extending from said support to said atomization assembly to hold said atomization assembly at a predetermined location relative to said fixed position, said wire-like mounting structure having a small cross section relative to its length to minimize migration of liquid between said atomization assembly and said support.

2. A device according to claim 1, wherein said mounting structure is flexible and resilient.

3. A device according to claim 1, wherein said mounting structure is electrically conductive.

4. A device according to claim 1, wherein said mounting structure is arranged as a cantilever to hold said actuator out from said support.

5. A device according to claim 1, wherein said mounting structure is made of spring steel.

6. A device according to claim 1, wherein said mounting structure is made of a material which is not easily wettable by liquid being atomized.

7. A liquid atomization device comprising:

a housing;

a liquid atomization plate secured to a piezoelectric actuating element to be vibrated thereby in response to alternating voltages applied to said actuating element, the vibration of said plate causing atomization of liquid supplied thereto;

an electrical circuit mounted in said housing for supplying alternating electrical voltages;

a pair of electrically conductive wire-like cantilever elements connected to receive alternating voltages from said electrical circuit, said wire-like elements extending from a fixed support in said housing and being in electrical contact with opposite sides of said actuating element to apply said alternating voltages across said actuating element, said wire-like elements supporting said actuating element and said liquid atomization plate in cantilever fashion in said housing; and a liquid delivery system arranged to deliver a liquid to be atomized to said atomization plate while it is being vibrated.

8. A device according to claim 7, wherein said electrical circuit is formed on a printed circuit board and wherein said cantilever elements are fixed to and extend from said printed circuit board.

9. A device according to claim 7, wherein said wire-like elements are resiliently bendable.

10. A device according to claim 7, wherein said wire-like elements are resiliently biased against opposite sides of said actuator element.

11. A device according to claim 7, wherein said wire-like elements are shaped to extend along the sides of said actuator element.

12. A device according to claim 7, wherein said piezoelectric actuator element has an annular shape with flat sides and wherein said wire-like elements are curved where they contact the sides of said actuator element.

13. A device according to claim 9, wherein at least one of said wire-like elements is shaped in the form of a helix where it contacts said actuator element.

14. A support for a piezoelectric actuator and an atomization plate coupled thereto to be vibrated thereby, said support comprising:

a housing having an internal cavity;

a piezoelectric actuator and an atomization plate coupled to said actuator to be vibrated thereby upon energization of said actuator, said actuator and said plate being located in said cavity;

a resilient element arranged in said cavity to press against said actuator and to support said actuator in said housing for movement against a resilient bias;

said housing member having openings from said cavity which are in alignment with said atomization plate for the passage of liquid from an external supply to said plate and for the passage of liquid droplets from said plate to the atmosphere.

15. A support according to claim 14, wherein at least one of said wires is in the form of a resilient helix within said housing, said resilient helix constituting said resilient element, whereby said wires are held in electrical contact with said piezoelectric actuator.

16. A support according to claim 15, wherein said wires enter into said cavity via slots in said housing member.

17. A support according to claim 16, wherein said slots extend along a side of said housing member from its open end to locations along said cavity.

18. A support according to claim 14, wherein said atomization plate is an orifice plate, and further including a back pressure element abutting a lower surface of said plate.

19. A support according to claim 18, wherein said back pressure element is constructed to maintain a continuous supply of liquid to the underside of said orifice plate to avoid the accumulation of bubbles thereon.

20. A support according to claim 19, wherein said back pressure element is formed of compressed polypropylene fibers.

21. A support according to claim 14, wherein said internal cavity opens out from one side of said housing, said support further including a cover member extending over said one side to close said cavity, said cover member being fastened to said housing and causing said resilient member to press against said actuator.

22. A support according to claim 21, wherein said cover is snap fitted to said housing.

23. A support according to claim 15, wherein said helix is formed with protruding ears which project into slots or recesses in said housing to hold said helix in said cavity.

24. A liquid delivery system for transferring liquid from a reservoir to a vibrating atomization plate, said liquid delivery system comprising:

a solid tubular member having a longitudinal passage extending therethrough; and a solid rod extending through said longitudinal passage;

said solid tubular member and said solid rod having mutually facing surfaces which are configured to form capillary passages when said solid rod is positioned to extend through said longitudinal passage, the capillary passages extending from one end of said tubular member to the other.

25. A system according to claim 24, wherein said solid tubular member and said solid rod are formed with mutually engaging shoulders to provide precise positioning of said rod with respect to said tubular member.

26. A system according to claim 24, wherein said tubular member is slit longitudinally at the bottom thereof to form outwardly bendable tabs.

27. A system according to claim 24, wherein said solid rod extends out through the top of the tubular member.

28. A system according to claim 27, wherein said solid rod has longitudinal serrations at its upper end.

29. A system according to claim 24, wherein said solid tubular member is a portion of a plug element which closes the upper end of a liquid reservoir.

30. A system according to claim 24, wherein said solid tubular member is formed with an upwardly facing abutment surface at the upper end thereof.

31. A system according to claim 24, wherein said solid tubular member is formed at its upper end with an upwardly open annular channel surrounding said solid rod.

32. A system according to claim 31, wherein said annular channel is formed with a vent hole in the bottom thereof which extends into a liquid reservoir.

33. A piezoelectric atomization device comprising:

a structural support;

a liquid reservoir comprising a liquid container and a liquid delivery system extending from within said liquid container to a location above said liquid container, said liquid delivery system being of a solid material and dimensionally stable;

an atomizer assembly comprising a piezoelectric actuator and an orifice plate coupled to said actuator to be vibrated thereby upon energization of said actuator to atomize liquid supplied to an under surface of said orifice plate;

said liquid reservoir being replaceably mounted on said structural support;

said atomizer assembly also being mounted on said structural support in a manner such that said under surface of said orifice plate is located above and in alignment with an upper surface of said liquid delivery system;

at least one of said liquid reservoir and said atomizer assembly being resiliently mounted by means of said structural support for up and down movement against a resilient bias, whereby said upper surface of said liquid delivery system engages said under surface of said orifice plate irrespective of the vertical position of said upper surface of said liquid delivery system when said liquid reservoir is mounted onto said structural support.

34. An atomization device according to claim 33, wherein said structural support is formed in a housing which contains said liquid reservoir and said atomizer assembly.

35. An atomization device according to claim 34, wherein said atomizer assembly is resiliently mounted in said housing by means of a resilient mounting system.

36. An atomization device according to claim 35, wherein said resilient mounting system comprises resilient elongated wire-like support elements, each fixed to extend in cantilever fashion from a support in said housing to said atomizer assembly.

37. An atomization device according to claim 36, wherein at least one of said wire-like support elements presses against an underside of said piezoelectric actuator and wherein another of said wire-like support elements presses against an opposite side of said piezoelectric actuator.

38. An atomization device according to claim 37, wherein the ends of said wire-like support elements are anchored to support formations in said housing.

39. An atomization device according to claim 38, further including an electrical circuit capable of generating alternating voltages and supplying said voltages to opposite sides of said piezoelectric actuator, thereby to impose alternating electrical fields across said piezoelectric actuator.

40. An atomization device according to claim 39, wherein said wire-like support elements are electrically conductive and wherein said wire-like support elements are electrically connected to said electrical circuit.

41. An atomization device according to claim 40, wherein said electrical circuit is formed on a printed circuit board supported in said housing and wherein said electrical circuit is connected to said opposite ends of said wire-like support elements.

42. A piezoelectric atomizing device comprising:

a support;

a piezoelectric actuator and an atomization plate coupled thereto to be vibrated thereby, said support comprising elongated resilient members which extend out from said support to said piezoelectric actuator and which press against opposite sides of said piezoelectric actuator to hold said actuator and plate in cantilever fashion in a position from which said actuator is moveable under force.

43. An atomizing device according to claim 42, wherein said elongated resilient members are electrically conductive and are connected to transfer energizing voltages from a circuit on said support to opposite sides, respectively, of said piezoelectric element.

44. An atomizing device according to claim 43, wherein said elongated resilient members are shaped to lie along and press against, opposite surfaces, respectively, of said actuator.

45. An atomization device according to claim 42, wherein an outer end of at least one of said elongated resilient members is formed as a helix which presses against a corresponding surface of said actuator.

46. An atomization device according to claim 42, wherein said piezoelectric actuator is annularly shaped and has a center hole and wherein said atomization plate is an orifice plate which extends across said center hole and is fixed to said piezoelectric actuator.

47. An atomization device according to claim 46, wherein said elongated resilient members are fixed at their ends to said support and wherein center regions of said elongated resilient members are configured to press against upper and lower surfaces, respectively, of said piezoelectric actuator.

48. An atomization device according to claim 43, and further including an electrical circuit constructed to supply alternating electrical voltages to said piezoelectric actuator via said elongated resilient members.

49. An atomization deice according to claim 42, wherein said piezoelectric actuator is annularly shaped and has a center hole and wherein said atomization plate is circular and extends across said center hole and is fixed to said piezoelectric actuator, one of said elongated resilient members being fixed at its ends to said support, and a region of said one elongated resilient member between its ends being shaped to extend at least part way around one side of said piezoelectric actuator, and another of said elongated resilient members also being fixed at its ends to said support and a region of said another elongated resilient member between its ends extending across secants on the opposite side of said piezoelectric actuator.

50. An atomization device according to claim 49, wherein said elongated resilient members are electrically conductive and are connected to an electrical circuit for supplying alternating voltages to opposite sides of said piezoelectric actuator.

51. An atomization device according to claim 50, wherein said electrical circuit is mounted on said support and wherein said electrical circuit is connected to said elongated resilient members where they are fixed to said support.

52. An atomization device according to claim 49, wherein a portion of said another elongated resilient member extends beyond said secants and is also supported by said support.

53. An atomization device according to claim 52, wherein support posts extend from said support, and wherein the ends of said each of said elongated resilient support members are anchored to support posts extending from said support.

54. An atomization device according to claim 53, wherein said portion of said another elongated resilient member extends through and is supported by a further support element which extends from said support.

55. An atomization device according to claim 52, wherein said another support member is formed with vertical portions which extend along outer edges of said actuator at each end of said secants.

* * * * *

UNITED STATES PATENT AND TRADEMARK OFFICE

CERTIFICATE OF CORRECTION

PATENT NO. : 6,843,430 B2
APPLICATION NO. : 10/154509
DATED : January 18, 2005
INVENTOR(S) : John A. Boticki et al.

It is certified that error appears in the above-identified patent and that said Letters Patent is hereby corrected as shown below:

Column 18: Line 60, replace “deice” with --device--

Signed and Sealed this

Twelfth Day of August, 2008

JON W. DUDAS
*Director of the United States Patent and Trademark Office*